US009731877B2

(12) United States Patent
Aneas

(10) Patent No.: US 9,731,877 B2
(45) Date of Patent: Aug. 15, 2017

(54) SEALING DEVICE AND CONTAINER EQUIPPED WITH SUCH A DEVICE

(71) Applicant: Biocorp Recherche et Developpement, Issoire (FR)

(72) Inventor: Antoine Aneas, Menetrol (FR)

(73) Assignee: Biocorp Recherche et Developpement, Issoire (FR)

( * ) Notice: Subject to any disclaimer, the term of this patent is extended or adjusted under 35 U.S.C. 154(b) by 21 days.

(21) Appl. No.: 14/383,863

(22) PCT Filed: Mar. 8, 2013

(86) PCT No.: PCT/EP2013/054693
§ 371 (c)(1),
(2) Date: Sep. 8, 2014

(87) PCT Pub. No.: WO2013/132050
PCT Pub. Date: Sep. 12, 2013

(65) Prior Publication Data

US 2015/0014271 A1 Jan. 15, 2015

(30) Foreign Application Priority Data

Mar. 9, 2012 (FR) ..... 12 52143

(51) Int. Cl.
*B65D 51/00* (2006.01)

(52) U.S. Cl.
CPC ..... *B65D 51/00* (2013.01); *B65D 51/002* (2013.01)

(58) Field of Classification Search
CPC .. B65D 51/20; B65D 51/002; B65D 41/0471; B65D 41/04
USPC ..... 215/227, 249, 315, 277, 216, 330, 331, 215/329, 310; 220/288, 293, 296
See application file for complete search history.

(56) References Cited

U.S. PATENT DOCUMENTS 5,314,084 A 5/1994 Folta et al.
5,718,348 A * 2/1998 Manera ..... B65D 41/28 215/249

(Continued)

FOREIGN PATENT DOCUMENTS

FR 2 950 035 A1 3/2011

OTHER PUBLICATIONS

PCT/EP2013/054693, Rapport de Recherche Internationale (French), Apr. 22, 2013.

(Continued)

*Primary Examiner* — Anthony Stashick
*Assistant Examiner* — Raven Collins
(74) *Attorney, Agent, or Firm* — Soquel Group LLC

(57) ABSTRACT

A sealing device for a container comprising a circular cap designed to seal the neck of the container and a cover made from a synthetic material capable of covering both the neck and the cap fitted on the neck, the cover being provided with means for locking onto the neck, the cover being in one piece and comprising a skirt capable of radially surrounding a collar of the neck of the container, and an annular portion provided with a central opening allowing permanent access to the cap, and the skirt having at least two jamming areas for jamming the cap and, on the inner radial face thereof between the two jamming areas, a release area with a diameter strictly greater than the minimum unstressed diameter of the cap.

20 Claims, 6 Drawing Sheets

(56) References Cited

U.S. PATENT DOCUMENTS

| | | | | |
|---|---|---|---|---|
| 5,992,660 | A * | 11/1999 | Miura | B65D 51/002 215/247 |
| 9,260,227 | B2 * | 2/2016 | Kawamura | B65D 51/002 |
| 2001/0020607 | A1 * | 9/2001 | Chiarin | 215/247 |
| 2009/0301987 | A1 * | 12/2009 | Luzzato | B65D 41/045 215/253 |
| 2010/0089862 | A1 | 4/2010 | Schmitt | |
| 2010/0224632 | A1 | 9/2010 | Aneas | |
| 2012/0160850 | A1 | 6/2012 | Gelibert et al. | |

OTHER PUBLICATIONS

PCT/EP2013/054693, International Search Report (English), Apr. 22, 2013.
PCT/EP2013/054693, Rapport Préliminaire International sur la Brevetabilité (French), Apr. 22, 2013.
FR 12 52143, Annex to International Preliminary Report on Patentability (English), Feb. 28, 2013.
FR 12 52143, Rapport de Recherche Préliminaire (French), Feb. 28, 2013.
PCT/EP2013/054693, International Preliminary Report on Patentability (English), Apr. 22, 2013.

* cited by examiner

SEALING DEVICE AND CONTAINER EQUIPPED WITH SUCH A DEVICE

FIELD OF THE INVENTION

The invention relates to a sealing device for a container, said device comprising a circular stopper designed to seal the neck of the container, as well as a cap. The invention also relates to a container, for example a drug cartridge, equipped with such a sealing device.

BACKGROUND OF THE INVENTION

It is known to store certain drugs injectable by parental administration in liquid form in a container made from glass named "cartridge" having a diameter of 7 mm and sealed by a sealing washer. The drugs thus stored are ready to be used in syringes, for example, for dental care, or in injector pens.

Once filled with a drug, a cartridge is normally sealed by a sealing washer covered by a capsule made from aluminium. Said principle of sealing is widely used because it guarantees a good stability of the active principle of the drug, as well as the integrity of the drug to be conserved. With the current systems, the sealing washer is pre-installed inside the capsule made from aluminium, then same is crimped on the neck of the cartridge by means of a knurling tool. Such a method of crimping capsules made from aluminium is likely to generate debris from aluminium, glass or paint applied on the capsule made from aluminium, which makes said method incompatible with a use in a cleanroom of class ISO 5 according to the standard ISO 146 44. Moreover, there remains a risk of rotation of the sealing washer in relation to the cartridge, to the extent that the sealing washer does not fulfil the function thereof of isolation of the interior volume of the cartridge in relation to the exterior, hence a risk of deterioration of the active principle of the drug. Finally, the particles of aluminium, glass or paint released during the crimping are likely to pollute the upper surface of the sealing washer which is accessible via the capsule. During the perforation of the sealing washer for sampling the contents of the cartridge, said particles deposited on the surface of the sealing washer risk contaminating the product contained in the cartridge and, consequently, the patient. This is all the more significant as certain drugs packaged in cartridges are used for long-term treatments by means of injector pens, for example, insulin injector pens.

It is known from WO-A-94/04424 to use a cap made from multi-piece plastic material that is intended to be immobilised around the stopper of the sealing device. Said relatively complex structure is both expensive to manufacture and bulky, such that same is not adapted to the sealing of a container of small cross-sectional dimensions, such as a cartridge. Moreover, if the dimensions of the device known from WO-A-94/04424 were reduced in view of the use thereof on a container of small cross-sectional dimensions, such as a cartridge, the compressive force necessary for securing the stopper on the neck of the container would result in a radial expansion of said stopper likely to tear the cap.

SUMMARY

The invention more specifically intends to overcome said drawbacks by proposing a new sealing device particularly suitable for a cartridge and which enables an effective isolation of the contents of the container, without risk of loss of the physical integrity thereof.

To this effect, the invention relates to a sealing device for a container, said sealing device comprising a circular stopper designed to seal the neck of the container and a cap made from synthetic material capable of covering both the neck and the stopper fitted on said neck, said cap being provided with means for locking onto the neck. In accordance with the invention,

- the cap is in one piece and comprises a skirt, capable of radially surrounding a collar of the neck of the container, as well as an annular portion provided with a central opening allowing permanent access to the stopper,
- the skirt has at least two jamming areas for jamming the stopper and
- the skirt has, on the inner radial surface thereof and between the two jamming areas for jamming the stopper, a release area with a diameter strictly greater than the minimum unstressed diameter of the stopper.

Thanks to the invention, the one-piece structure of the cap made from synthetic material enables same to effectively provide a function of isolation of the stopper, whilst being of an attractive cost. The installation thereof on the neck of the container is not likely to release particles of metal or paint. The jamming areas for jamming the stopper make it possible to temporarily hold the stopper inside the cap, before installation of the cap on the container. The release areas make it possible to accommodate a radial expansion of the stopper when exposed to an axial compressive force which firmly secures the stopper against the surface of the neck opposite the bottom of the vial. Thus, the cap is not likely to break or tear when exposed to a centrifugal force exerted by the stopper due to the radial expansion thereof.

According to advantageous but not mandatory aspects of the invention, such a sealing device may incorporate one or more of the following features, taken in all admissible technical combinations:

- The stopper is a washer made from elastomer.
- The outside diameter of the skirt is less than 8.5 mm, preferably less than 8.25 mm, more preferably equal to 8.1 mm.
- In each release area, the skirt has a radial thickness less than 0.35 mm, preferably equal to 0.3 mm.
- The skirt has three jamming areas for jamming the stopper evenly distributed about a central axis of the skirt, as well as a release area between each pair of adjacent jamming areas.
- The locking means comprise teeth each having a surface practically perpendicular to a central axis of the skirt, whereas each release area is aligned, in a direction parallel to the central axis, with a locking tooth.
- The skirt has three release areas and each release area extends, in relation to the central axis of the skirt, over an angular sector with an angle at the apex having a value between 65° and 75°.
- Each locking tooth extends, in relation to the central axis of the skirt, over an angular sector with an angle at the apex having a value less than that of the angle at the apex of the angular sector of a release area.

The invention also relates to a container, in particular a drug cartridge, equipped with a sealing device as mentioned above. Such a container can be manufactured in a more reliable manner than those of the prior art, with a particularly attractive cost.

Advantageously, said container has an outside diameter between 8.55 and 12 mm and the skirt of the sealing device has an outside diameter strictly smaller than the outside diameter of the container, preferably equal to 8.1 mm.

BRIEF DESCRIPTION OF THE DRAWINGS

The invention will be better understood and other advantages thereof will appear more clearly in light of the following description of one embodiment of a sealing device and of a container according to the principle thereof, given only as an example and made in reference to the appended drawings, wherein.

DETAILED DESCRIPTION

Figure 1:
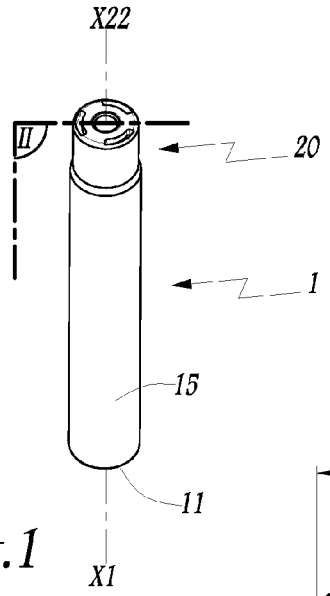
FIG. 1 is a perspective view of a drug storage cartridge equipped with a sealing device according to the invention.

The container 1 made from glass shown in the figures is a cartridge, that is to say an elongated-shaped vial centred on a longitudinal axis X1 and having a circular section cylindrical body 11 the outside diameter D1 of which is between 8.55 and 12 mm. Alternatively, the cartridge 1 can be made from plastic material. Said cartridge is provided with a neck 12 defining a mouth 13 through which it is possible to fill the cartridge 1 and which is surrounded by a collar 14 on which 141 denotes an annular surface surrounding the opening of the mouth 13 and 142 denotes an annular surface oriented opposite the surface 141 and rotated towards the body 11 and towards the bottom 15 of said body.

The bottom 15 may consist of a piston moveable along the axis X1 inside the body 11.

A sealing device 20 is mounted on the neck 12 and comprises a stopper 21 formed by a washer made from elastomer which is circular and centred on an axis X21. The outer peripheral surface 211 of the stopper 21 is frustoconical and converging in the direction of a disc-shaped surface 212, opposite another surface 213 also disc-shaped. Considering the normal configuration of storage of the cartridge 1, in which same rests with the bottom 15 thereof on a flat and horizontal surface, the surface 212 is referred to as upper surface, whereas the surface 213 is referred to as lower surface.

The sealing device 20 also comprises a cap 22 made by moulding of plastic material, for example, polyoxymethylene.

Said cap is in one piece and comprises a skirt 221 centred on a central axis X22 of the cap 22 and the outer peripheral surface 222 of which is cylindrical and with a circular section centred on the axis X22. The cap 22 also comprises an annular portion 231 which extends from the skirt 221 and in the direction of the axis X22. Said annular portion is connected to the skirt 221 by three branches 241 evenly distributed, at 120° from one another, about the axis X22. The annular portion 231 defines an opening 232 centred on the axis X22 which allows permanent access to the surface 212 of the stopper 21, when said stopper is inserted inside the cap.

Along the skirt 221, between two adjacent branches 241, the cap 22 is provided with three circular arc-shaped openings 251 and which each extend along an angular sector the angle at the apex of which is noted $\alpha$. In practice, said angle $\alpha$ has a value between 65° and 75°, preferably around 70°.

Furthermore, the cap 22 is provided with three teeth 261 evenly distributed about the axis X22 and designed for locking the cap 22 in place on the neck 12. Each tooth 261 comprises a surface 262 which is practically perpendicular to the axis X22 as well as a surface 263 which is frustoconical and diverging opposite the portion 231, that is to say in the direction of the edge 223 of the skirt 221 opposite the openings 251. In reference to the figures, said edge is referred to as lower edge, whereas the portion 231 is considered as arranged at the level of the upper edge 224 of the skirt 221.

The surface 262 is practically perpendicular to the axis X22 in this sense that a straight line aligned on said surface, in a plane radial to the axis X22, forms with said axis an angle superior to 70°, preferably to 75°. Said orientation of the surface 262 provides effective anchoring of each tooth 261 under the collar 14, against the surface 142.

In mounted configuration of the cap 22 on the neck 12, the surface 262 of each tooth 261 is facing and opposite the surface 142.

The maximum unstressed diameter of the stopper 21 is noted $D21_{max}$, that is to say in practice the diameter of the lower surface 213, before installation of the stopper 21 in the cap 22. The minimum unstressed diameter of the stopper 21 is noted $D21_{min}$, that is to say in practice the diameter of the surface 212, before installation of the stopper 21 in the cap 22.

Figure 4:
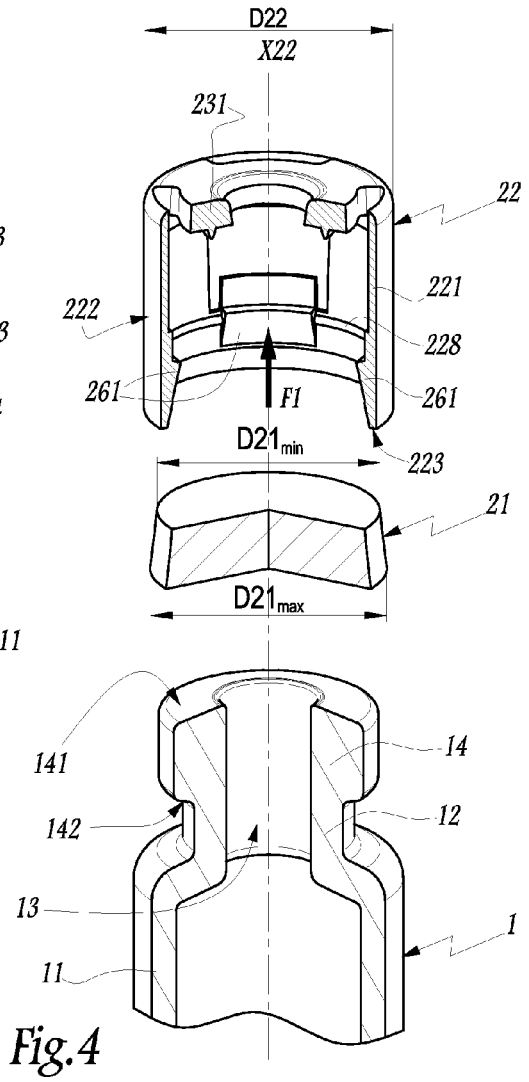
FIG. 4 is an exploded perspective view, with partial cut away, of the portions shown in FIGS. 2 and 3.
Figure 5:
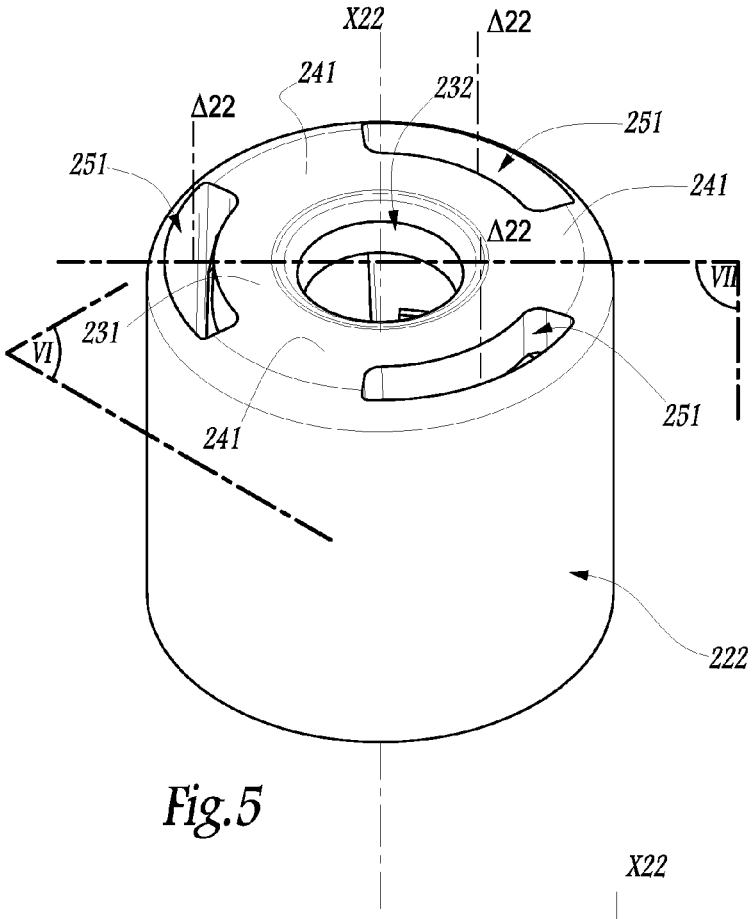
FIG. 5 is perspective view on a larger scale of a cap shown in FIGS. 1 to 4.
Figure 6:
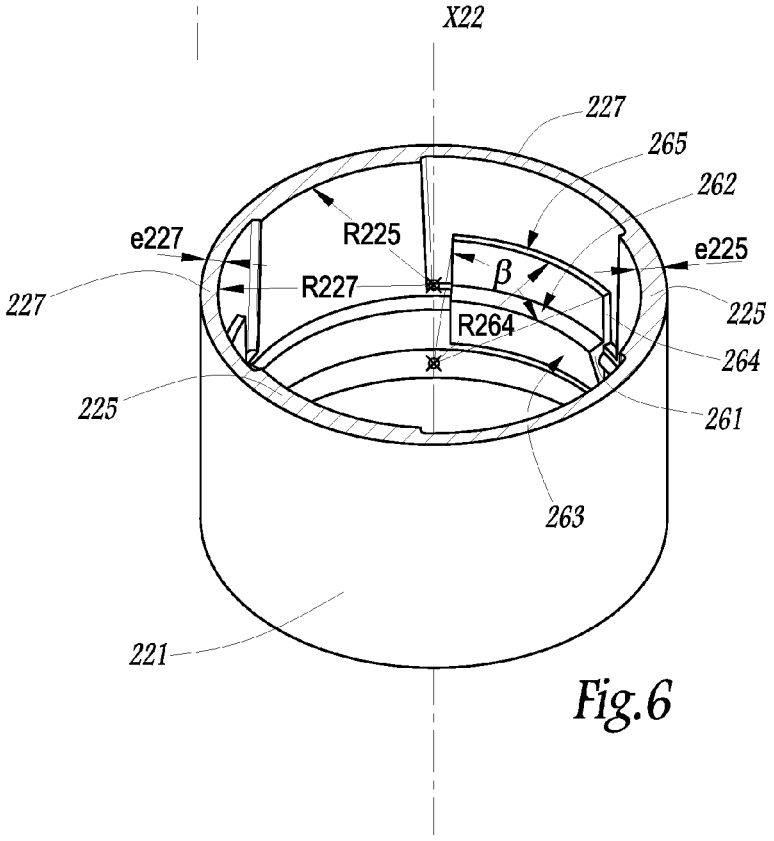
FIG. 6 is a cross-section in perspective along the plane VI in FIG. 5.
Figure 7:
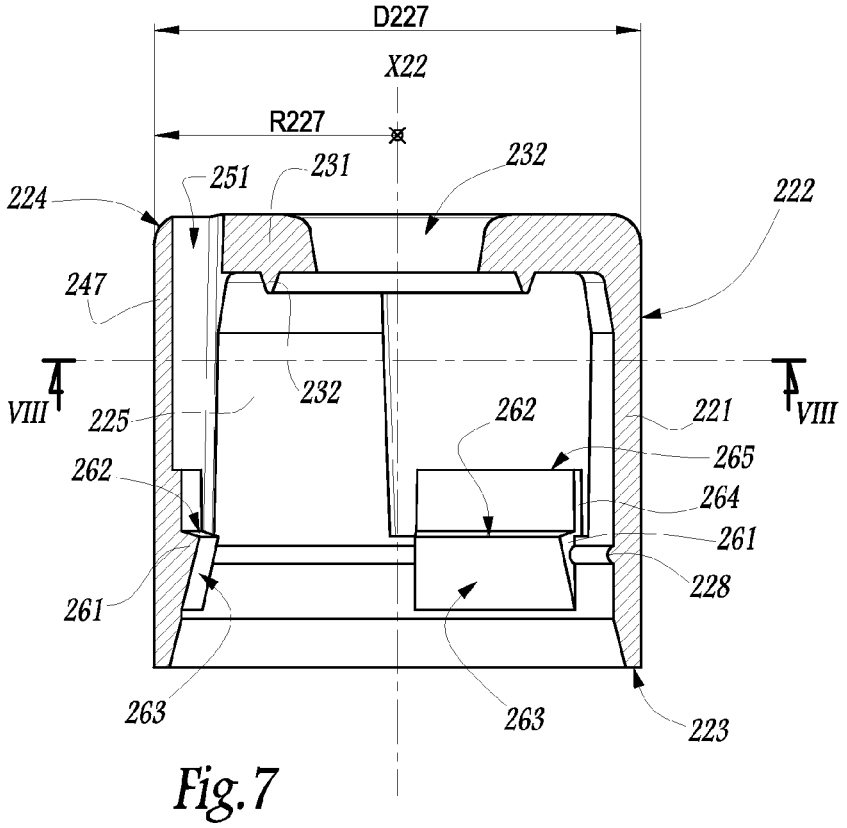
FIG. 7 is a cross-section along the plane VII in FIG. 5.
Figure 8:
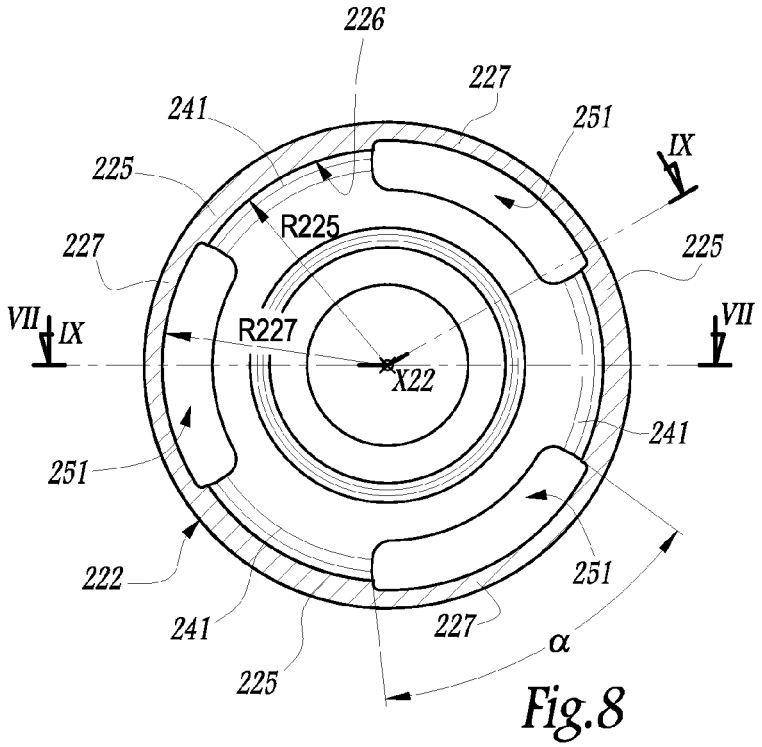
FIG. 8 is a cross-section along the line VIII-VIII in FIG. 7, the plane of the cross-section in FIG. 7 has been shown here as VII-VII.
Figure 9:
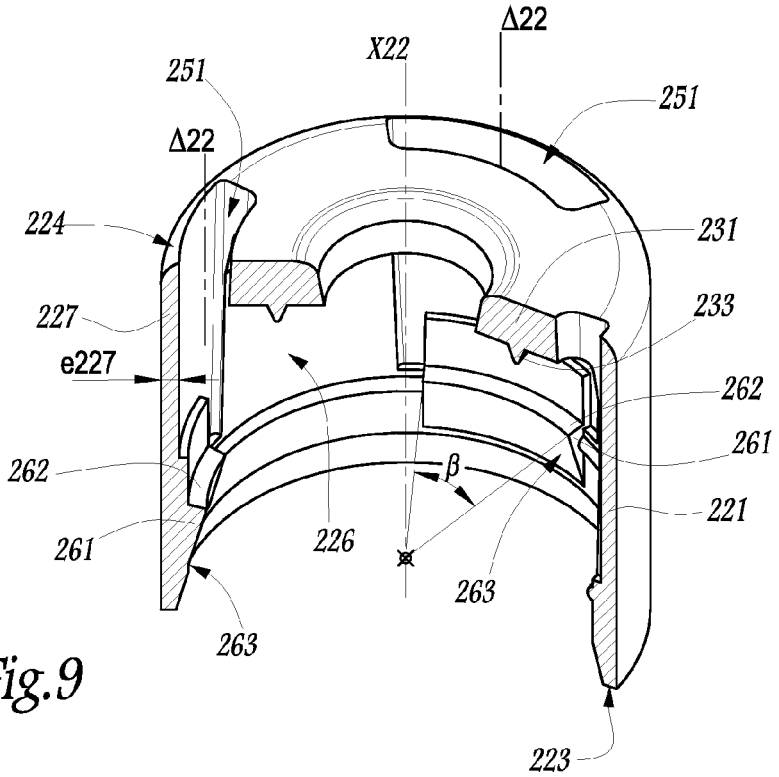
FIG. 9 is a cross-section along the line IX-IX in FIG. 8.

The skirt 221 is provided with three areas 225 evenly distributed about an axis X22 and in each one of which the inner radial surface 226 of the skirt 221 has a radius R225 equal to or slightly smaller than half of the diameter $D21_{max}$. Thus, the three areas 225 make it possible to retain, by radial jamming and/or friction, the stopper 21 inside the cap 22 when same is inserted inside the cap in the direction of the arrow F1 in FIG. 4.

The skirt 221 is provided, on the inner surface 226 thereof, with a peripheral bead 228 which connects the teeth 261 and which makes it possible to hold the cap 22 in position in the mould thereof, during the unmoulding thereof.

Furthermore, the portion 231 is provided with a circular rib 233 arranged on the inner surface 234 thereof, on the inner volume side of the cap 221 and which is intended for superficially penetrating the surface 212 of the stopper 21, when the sealing device 20 is fitted in the cartridge 1.

The inner radial surface 226 of the skirt 221 does not have a constant radius about the axis X22 but comprises three areas 227 in which the radius of the surface 226 has a value R227 greater than that of the radius R225. In practice, the radius R227 is strictly greater than half of the diameter $D21_{min}$, more specifically greater by 0.15 mm more than half of said radius. In other words, the diameter D227 of the surface 226, which is equal to the double of the radius R227, is strictly greater than the diameter $D21_{min}$, by 0.3 mm.

Figure 10:
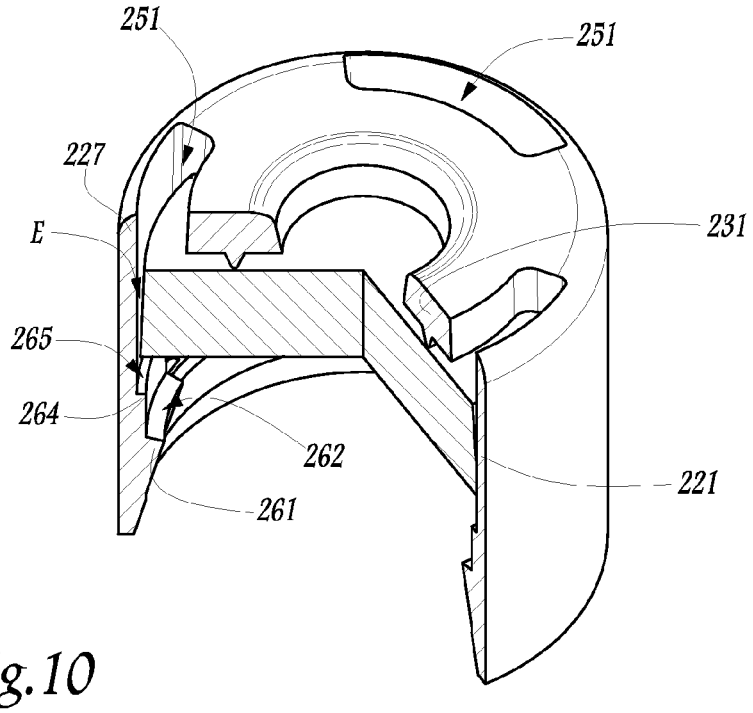
FIG. 10 is a cross-section in perspective when the stopper of the sealing device is pre-mounted in the cap, before installation on the neck of the cartridge.
Figure 11:
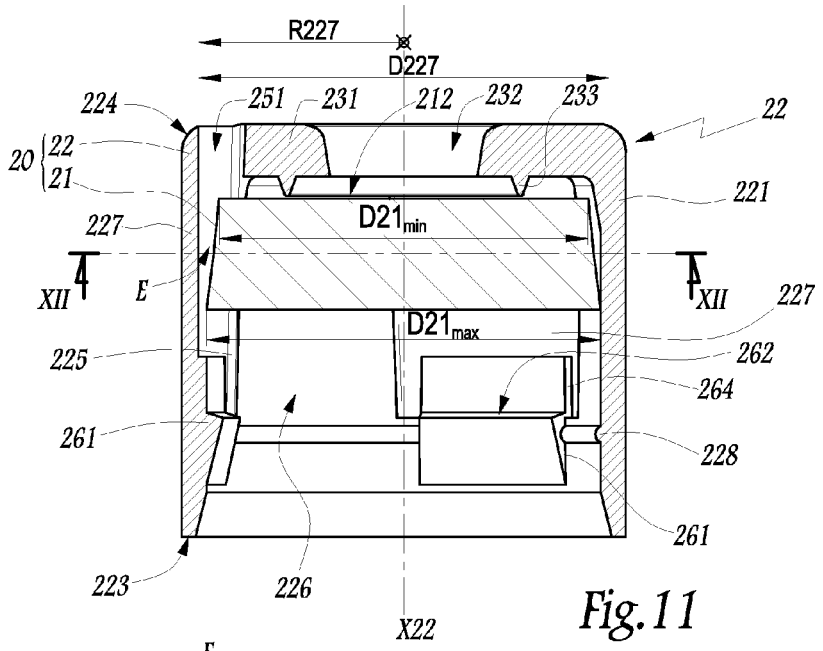
FIG. 11 is a cross-section equivalent to FIG. 7 in the configuration of FIG. 10.
Figure 12:
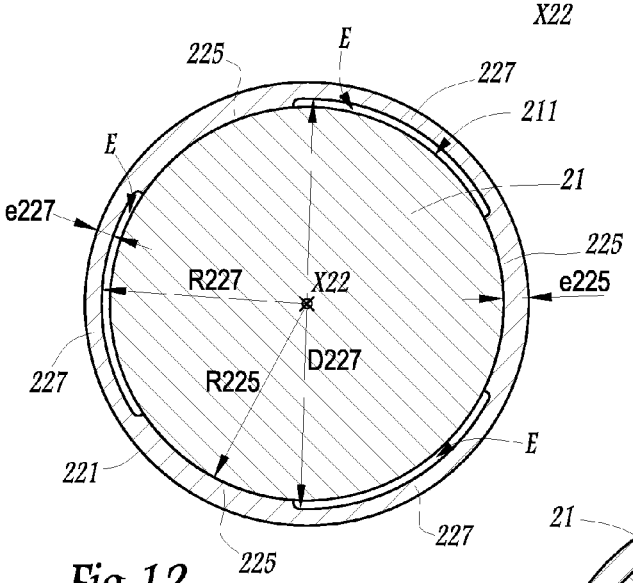
FIG. 12 is a cross-section along the line IX-IX in FIG. 11

Thus, when the stopper 21 is placed in the capsule 22 in pre-mounted configuration shown in FIGS. 10 to 12, a free space E is arranged between the outer external surface 211 of the stopper 21 and the inner radial surface 226 of the skirt 221 at the level of the release areas 227. Said free space does not affect the holding in position of the stopper 21 in the cap 22 since said holding in position is provided by the interaction of the stopper 21 with the jamming areas 225.

Moreover, each tooth 261 is extended in the direction of the edge 224 of the skirt 221 by a back 264 which defines, opposite the surface 262, a shoulder 265 perpendicular to the axis X22 and oriented towards the edge 224. The inside radius R264 of a back 264 is smaller than or equal to the radius R225, such that the shoulder 265 constitutes a stop to possible movement of the stopper 211 in the direction of the lower edge 223 of the skirt 221.

Each tooth 261 extends, in relation to the axis X20 along an angular sector the angle at the apex of which is noted β. This angle has a value between 45° and 55°, said value being less than the value of the angle α.

The teeth 261 are placed, in relation to the axis X22, in angular sectors incorporated into the angular sectors of the openings 251. In other words, the teeth 261 and the openings 251 are aligned two by two in directions Δ22 parallel with the axis X22. This makes it possible to produce the openings 221 and release areas 227 by means of a sliding block for forming the surfaces 262 and 265 of the teeth 261 and of the backs 264 during the moulding of the cap 22, in a single operation. The values of the angles α and β make said moulding possible in one operation.

Figure 2:
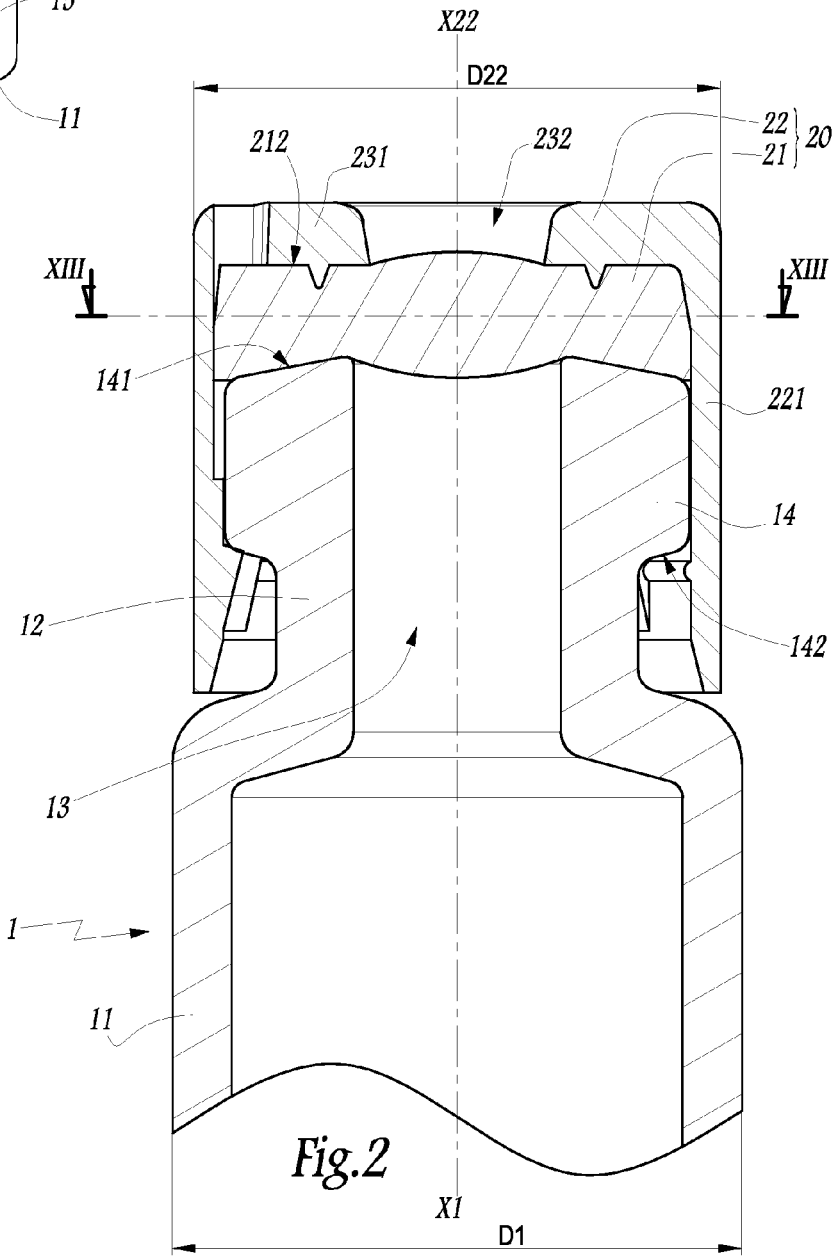
FIG. 2 is a partial cross-section on a larger scale along the plane II in FIG. 1.
Figure 3:
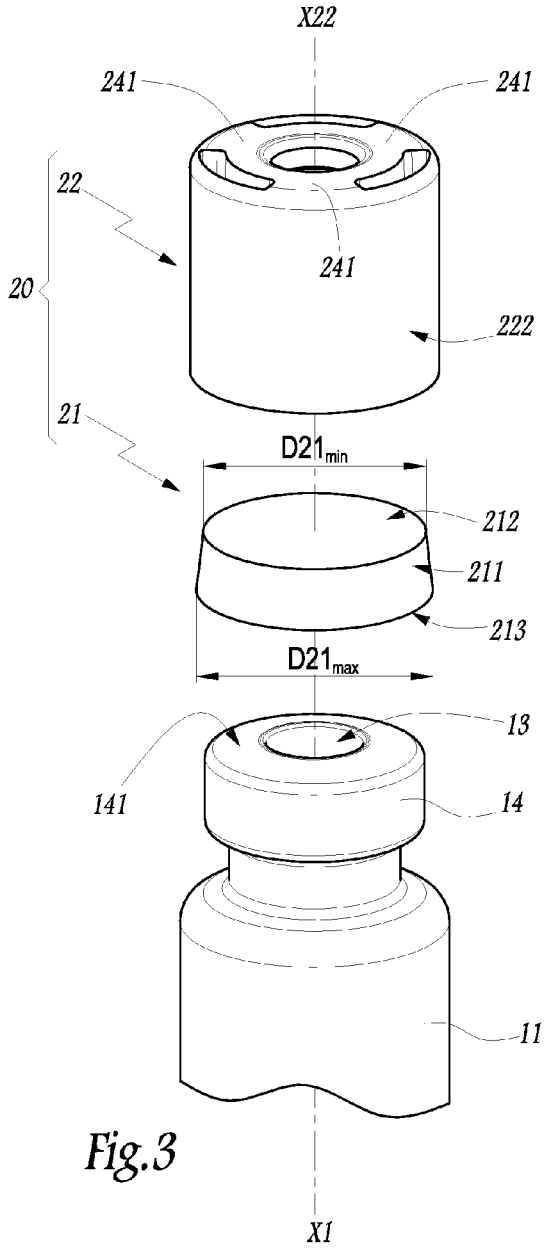
FIG. 3 is an exploded view in perspective and on a smaller scale of the portion of the cartridge and of the sealing device shown in FIG. 2.
Figure 13:
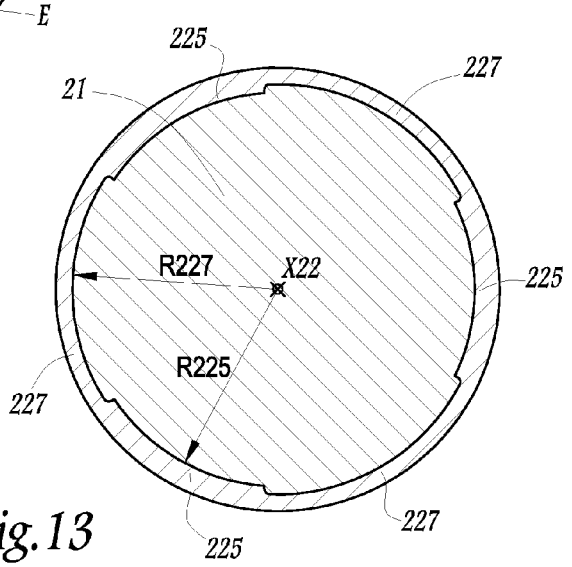
FIG. 13 is a cross-section along the line VIII-VIII in FIG. 2, on the same scale as FIG. 12.

When the sealing device 20 is fitted on the cartridge 1, as shown in FIGS. 1, 2 and 13, the stopper 21 is compressed between the surface 234 of the portion 231 and the surface 141 of the collar 14. The rib 233 superficially penetrates the stopper 21. When exposed to the axial compression, the stopper 21 tends to expand radially in relation to the axes X1 and X22 which are then combined. This is possible by filling the spaces E previously existing at the level of the release areas 227. In other words, the release areas 227 make it possible to accommodate the radial expansion of the stopper 21 when exposed to the axial force that same experiences in order to effectively seal the mouth 13, without risk of tearing the skirt 221. Thus, as shown by comparing FIGS. 12 and 13, when the stopper 21 is axially compressed, same can expand radially opposite the areas 227, by filling the spaces E, without risk of tearing or plastically deforming the skirt 221.

The invention is shown in the figures in the case where the diameter $D21_{max}$ of the stopper 21, which is measured without stress on said stopper, is strictly smaller than the double of the radius R227. In practice, given the taper of the surface 211, it is possible that said maximum diameter $D21_{max}$ is equal to, or even slightly greater than, the double of the radius R227, so long as the minimum diameter $D21_{min}$ of the stopper 21 at the level of the upper surface 212 of the stopper 21 remains strictly smaller than the double of the radius R227. Indeed, in this case, the spaces E do not extend over the entire height of the stopper 21 but over the portion of same the unstressed diameter of which is strictly the double of the radius R227. In this case, the radial expansion of the stopper 21 when exposed to the compressive force only takes place in the vicinity of the upper surface 212 thereof.

According to another variation, the surface 211 of the stopper 21 can be cylindrical. In this case, the diameters $D21_{min}$ and $D21_{max}$ are identical and equal to a nominal diameter of the stopper. The radius R225 is then smaller than half of said nominal diameter, whereas the diameter D227 is strictly greater than said nominal diameter.

As the skirt 221 is fairly unstressed by the radial expansion of the stopper 21, the radial thickness thereof can be small. In particular, said radial thickness can have a value e227 at the level of the release areas 227 less than 0.35 mm, preferably equal to 0.3 mm. At the level of the areas 225, the radial thickness e225 of the skirt 221 has a value strictly greater than the value e227, in practice greater than 0.4 mm, preferably equal to 0.45 mm.

Given the small radial thickness of the skirt 221, the outside diameter D22 of the cap 22, that is to say that the diameter of the surface 222, can be strictly smaller than the diameter D1, for example, equal to 8.1 mm. Thus, the sealing device 20 does not radially protrude in relation to the body 11 of the cartridge, which is compatible with the use of the cartridge in an injector pen or any other equivalent device.

Alternatively, the number of areas 225 and 227 of openings 251 and of teeth 261 can be different by three. The number of areas 225 is greater than two in order to enable effective jamming of the stopper 21 in pre-mounted configuration.

The features of the embodiments and variations envisaged above can be combined together.

The invention claimed is:

1. A sealing device for a container, said sealing device comprising a circular stopper designed to seal the neck of the container and a cap made from synthetic material capable of covering both the neck and the stopper fitted on said neck, said cap being provided with means for locking onto the neck, wherein:

the cap is in one piece and comprises a skirt, capable of radially surrounding a collar of the neck of the container, as well as an annular portion provided with a central opening allowing permanent access to the stopper even when the entire sealing device closes the container, the skirt has, on the inner radial surface thereof, at least two jamming areas located axially, along a central longitudinal axis of the sealing device, at the level of an outer peripheral edge of the stopper, for radially jamming the stopper, the radius of the inner surface of the skirt in the jamming areas for jamming the stopper is smaller than or equal to half of the maximum unstressed diameter of the stopper, the skirt has, on the inner radial surface thereof and between the two jamming areas for jamming the stopper, a release area with an internal diameter strictly greater than the minimum unstressed diameter of the stopper, and the stopper is disc-shaped and made from an elastomer.

2. A sealing device according to claim 1, wherein the annular portion is connected to the skirt by branches, wherein circular arc-shaped openings are arranged between two branches and along the skirt and wherein the openings are aligned in directions parallel with a central axis of the skirt, with the teeth belonging to the locking means.

3. A sealing device according to claim 2, wherein the teeth are placed, in relation to the central axis, in angular sectors incorporated into the angular sectors of the openings.

4. A device according to claim 1, wherein the outside diameter of the skirt is less than 8.5 mm.

5. A device according to claim 1, wherein in each release area, the skirt has a radial thickness less than 0.35 mm.

6. A device according to claim 1, wherein the skirt has three jamming areas for jamming the stopper evenly distributed about a central axis of the skirt and a release area between each pair of adjacent jamming areas.

7. A device according to claim 1, wherein the locking means comprise teeth each having a surface practically perpendicular to a central axis of the skirt and wherein each release area is aligned, in a direction parallel to the central axis, with a locking tooth.

8. A sealing device according to claim 7, wherein each tooth is extended, in the direction of a upper edge of the skirt at the level of which is arranged the annular portion, by a back which defines a shoulder perpendicular to the central axis and oriented towards the upper edge of the skirt.

9. A sealing device according to claim 8, wherein the inside radius of a back is smaller than or equal to the radius of the inner surface of the skirt in a jamming area, such that the shoulder defined by said back constitutes a stop to possible movement of the stopper in the direction of a lower edge of the skirt opposite the upper edge.

10. A drug cartridge, equipped with a sealing device according to claim 1.

11. A drug cartridge according to claim 10, wherein the drug cartridge has an outside diameter between 8.55 and 12 mm and the skirt of the sealing device has an outside diameter strictly smaller than the outside diameter of the container.

12. A sealing device according to claim 4, wherein the outside diameter of the skirt is less than 8.25 mm.

13. A sealing device according to claim 4, wherein the outside diameter of the skirt is equal to 8.1 mm.

14. A sealing device according to claim 5, wherein in each release area, the skirt has a radial thickness equal to 0.3 mm.

15. A drug cartridge according to claim 11, wherein the skirt of the sealing device has an outside diameter equal to 8.1 mm.

16. A sealing device for a container, said sealing device comprising a circular stopper designed to seal the neck of the container and a cap made from synthetic material capable of covering both the neck and the stopper fitted on said neck, said cap being provided with means for locking onto the neck, wherein:

the cap is in one piece and comprises a skirt, capable of radially surrounding a collar of the neck of the container, as well as an annular portion provided with a central opening allowing permanent access to the stopper even when the entire sealing device closes the container, the skirt has, on the inner radial surface thereof, at least two jamming areas located axially, along a central longitudinal axis of the sealing device, at the level of an outer peripheral edge of the stopper, for radially jamming the stopper, the skirt has, on the inner radial surface thereof and between the two jamming areas for jamming the stopper, three release areas with an internal diameter strictly greater than the minimum unstressed diameter of the stopper, each release area extending, in relation to a central axis of the skirt, over an angular sector with an angle at the apex having a value between 65° and 75°, and the stopper is disc-shaped and made from an elastomer.

17. A device according to claim 16, wherein the locking means comprise teeth each having a surface practically perpendicular to a central axis of the skirt, wherein each release area is aligned, in a direction parallel to the central axis, with a locking tooth, and wherein each locking tooth extends, in relation to the central axis of the skirt, over an angular sector with an angle at the apex having a value less than that of the angle at the apex of the angular sector of a release area.

18. A drug cartridge, equipped with a sealing device according to claim 16.

19. A sealing device for a container, said sealing device comprising a circular stopper designed to seal the neck of the container and a cap made from synthetic material capable of covering both the neck and the stopper fitted on said neck, said cap being provided with means for locking onto the neck, wherein:

the cap is in one piece and comprises a skirt, capable of radially surrounding a collar of the neck of the container, as well as an annular portion provided with a central opening allowing permanent access to the stopper even when the entire sealing device closes the container, the skirt has, on the inner radial surface thereof, at least two jamming areas located axially, along a central longitudinal axis of the sealing device, at the level of an outer peripheral edge of the stopper, for radially jamming the stopper, the skirt has, on the inner radial surface thereof and between the two jamming areas for jamming the stopper, a release area with an internal diameter strictly greater than the minimum unstressed diameter of the stopper, the stopper is disc-shaped and made from an elastomer, the peripheral surface of the stopper is frustoconical and converging in the direction of a first surface, to which the central opening provides permanent access, and diverging in the direction of a second surface, a circular rib arranged on an inner surface of the annular portion superficially penetrates into the first surface, when the sealing device is fitted on the container, a minimum unstressed diameter of the stopper is equal to the diameter of the first surface, and a maximum unstressed diameter of the stopper is equal to the diameter of the second surface.

20. A drug cartridge, equipped with a sealing device according to claim 19.

* * * * *